US006666350B1

(12) United States Patent
Ludwig

(10) Patent No.: US 6,666,350 B1
(45) Date of Patent: Dec. 23, 2003

(54) DISPENSER WITH INTEGRAL SEPARATOR FOR REMOVING A BACKING FROM A SELF-ADHESIVE ARTICLE

(76) Inventor: Jonathan R. Ludwig, P.O. Box 596301, Fort Gratiot, MI (US) 48059-6301

( * ) Notice: Subject to any disclaimer, the term of this patent is extended or adjusted under 35 U.S.C. 154(b) by 90 days.

(21) Appl. No.: 10/143,333

(22) Filed: May 10, 2002

Related U.S. Application Data

(60) Provisional application No. 60/290,422, filed on May 11, 2001.

(51) Int. Cl.[7] ..... B65H 5/28
(52) U.S. Cl. ..... 221/73; 156/584
(58) Field of Search ..... 221/71, 73, 69, 221/70, 22, 210; 156/584, 541, 540

(56) References Cited

U.S. PATENT DOCUMENTS

| | | | |
|---|---|---|---|
| 1,056,330 | A | 3/1913 | Griel |
| 1,896,430 | A | 2/1933 | Stanawitz |
| 2,373,092 | A | 4/1945 | Avery |
| 2,419,809 | A | 4/1947 | Avery |
| 3,231,130 | A | 1/1966 | Foote |
| 3,554,847 | A | 1/1971 | Broemmlsiek |
| 3,913,786 | A | 10/1975 | Kartasuk |
| 3,955,711 | A | 5/1976 | Schroter et al. |
| 4,574,979 | A | 3/1986 | Hackett |
| 4,660,739 | A | 4/1987 | Dooley et al. |
| 4,685,994 | A | 8/1987 | Wodnicki |
| 4,767,022 | A | 8/1988 | Oldorf |
| 4,770,322 | A | 9/1988 | Slota et al. |
| 4,858,784 | A | 8/1989 | Moody |
| 5,065,896 | A | 11/1991 | Jurgich |
| 5,358,113 | A | 10/1994 | Hellenbrand |
| 5,494,168 | A | 2/1996 | Hart |
| 5,674,350 | A | 10/1997 | Jurgich |
| 5,806,713 | A | 9/1998 | Dudley et al. |
| 5,826,746 | A | 10/1998 | Ash, Jr. |
| 6,171,439 | B1 | 1/2001 | Groeneweg |

FOREIGN PATENT DOCUMENTS

| | | |
|---|---|---|
| DE | 26 26 129 | 12/1997 |
| GB | 783204 | 9/1957 |

OTHER PUBLICATIONS

"Premier" (TM) Model DL32 self–adhesive stamp affixer product package of Martin Yale Industries, Wabash, IN 46992, dated 1997.

"Pres–a–ply" (TM) self–stick paper reinforcement product & dispenser box of Dennison Manufacturing Co., Framington, MA 01701, dated before Apr. 7, 1997.

Dispenser product for moisten glue roll stamps. Manufacturer unknown. On the market since before Apr. 7, 1997.

Dispenser product for self–stick address labels. Manufacturer unknown. Believed on the market since before Apr. 7, 1997.

Dispenser product for self–stick address labels. Manufacturer unknown. Believed on the market since before Apr. 7, 1997.

*Primary Examiner*—Kenneth W. Noland
(74) *Attorney, Agent, or Firm*—Lynn E. Cargill

(57) ABSTRACT

A device for separating and dispensing strips of self-adhesive articles, such as postage stamps, labels and other materials formed in strips. Elongated strips of these self-adhesive articles are wound into rolls and supported upon a waxy backing layer and require separation for use. The separating dispenser may be a two-part assembly having a housing and a closure for the housing, with a slot therethrough, which the elongated strips of self-adhesive articles are dispensed and advanced through complementary guide pins that frictionally hold the dispensed material. The device can separate a backing layer from stripped material when the backing layer and the stripped material are directed along different paths and only the backing layer is advanced through the guide pins. The mechanism of the present invention advantageously permits efficient production and operation. In addition to being economical and easy to use, this invention has obvious reliability advantages.

8 Claims, 1 Drawing Sheet

DISPENSER WITH INTEGRAL SEPARATOR FOR REMOVING A BACKING FROM A SELF-ADHESIVE ARTICLE

CROSS REFERENCES TO RELATED APPLICATIONS

This application claims the benefit of U.S. Provisional Application No. 60/290,422 filed on May 11, 2001.

FIELD OF THE INVENTION

The present invention relates to dispensers for rolled self-adhesive articles with a backing layer, and more particularly, the present invention relates to a dispenser for rolled, self-adhesive postage stamps, labels and other self-adhesive articles.

BACKGROUND OF THE INVENTION

Self-adhesive articles have long been problematic in the past for daily usage, especially with regards to removing the weakly adhered back from self-adhesive postage stamps and self-adhesive labels. The self-stick adhesive allows for the stamps and labels to be removed by peeling off the backing layer. Office workers utilize these self-adhesive products all day long, and are in need of a reliable means for easily separating the backing from the self-adhesive article. More and more articles are utilizing the technology of self-adhesive articles with a backing layer made into a roll product, as the public demands more and more convenience items. In keeping pace with this technology, one of the many applications utilizing the self-adhesive technology includes the United States Postal Service which sells self-adhesive postage stamps that include elongated strips of paper stamps having a pre-gummed backing loosely adhered to a waxy backing layer. These postage stamps can be obtained in strips that are supported by the waxy backing layer and wound into rolls. Many previous products for dispensing self-adhesive materials, including postage stamps and labels, have proven to be unreliable, complex and require some physical effort. Prior art devices have attempted to provide such a separating dispenser, although they have not met with any great success. Without the features of the present invention, the prior art dispensers did not separate quite as nicely, nor did the self-adhesive article stick straight up, perfectly separated from the waxy backing layer all the time. Consequently, there continues to be a need for a device that is compact, easy-to-use, reliable, lightweight and economical.

It would be advantageous to have such an improved dispenser for automatically separating the self-adhesive articles, such as U.S. Post Office pre-gummed stamps, from the waxy backing layer. Besides the use with postage stamps, it would also be advantageous for such a dispenser to find utility with other self-adhesive strip materials, including stickers and labels. The device should be reliable and simplify the dispensing of self-adhesive materials as compared to the physical and mental effort required to properly use products currently available for dispensing self-adhesive materials.

A separating dispenser is desirable which will perfectly dispense the self-adhesive articles every time. Furthermore, the self-adhesive articles should be separated from the backing layer in such a manner that the stamp or label being removed from the backing layer will stick straight up, for ready handling and usage. Conventionally, there is a great tendency for the stamp or label to stick to the backing layer such that the self-adhesive article will not cleanly be separated, nor will the stamp end up in a configuration for truly easy removal. Usually, the stamp would somewhat follow the backing layer, and the user would have to do nearly as much work to separate he stamp from the backing layer, just in a different location.

SUMMARY OF THE INVENTION

In accordance with the above objectives and advantages, the present invention provides a separating dispenser for holding rolled self-adhesive articles, which need to be separated from the backing layer. The improved dispenser of the present invention automatically separates the self-adhesive articles, such as post office stamps, from the backing layer. The present invention is also adaptable for use with many other rolled self-adhesive labels, stickers and the like. The separating dispenser of the present invention perfectly dispenses self-adhesive articles every time, by separating the backing layer in a manner that the stamp being removed from the backing layer will stick straight up, ready to be handled by the user in an easy and reliable manner. In the prior art devices, the stamp tends to follow the backing layer through the dispenser, and the user is confronted with performing the same service whether the self-adhesive stamp is inside or outside the dispenser.

With reference to the preferred embodiment for the use of the dispenser for post office stamps, the dispenser includes a container having an interior space for receiving a roll of self-stick postage stamps therein. As is well known, 100 stamps are sold by the post office in a roll. The container has a slit which is adapted to allow linear passage there through of self-stick postage stamps. Adjacent to the slit and laterally off set therefrom is a guide bar wedge located next to guide pins, which are opened in the center. The guide bar wedge includes a small bar or wedge which is a higher than the guide pins in order to separate the backing from the stamp before the backing layer is received under the guide pins. Although it is preferable to use a pair of alternately disposed guide pins, the present invention also contemplates the use of a single, continuous guide pin.

In operation, the container is opened and a roll of self-stick postage stamps is placed therein. Of course, other self-adhesive materials made be included in this container, although within this discussion, we will restrict our comments to the use of self-adhesive postage stamps. The end of the self-stick postage stamps is passed-upwardly through the slit, the backing is pulled over the guide bar wedge, and the backing is slipped under the guide pins. Now, as the backing is pulled laterally, the self-stick postage stamps separate from the backing as the self-stick postage stamp advances outwardly through the slit. Following this operation, the postage stamp, now without the backing attached thereto, sticks straight up and is easy for the user to grab hold.

The following structural features aid in the facilitation of the operation of the above described dispenser. A lid is preferably provided which snappingly engages the body of the container and which has formed therein a slit. The guide bar or guide bar wedge, depending on which embodiment is used, is connected to the exterior side of the lid, proximal to the slit. Attached to the interior side of the lid is a stamp roll container for holding the roll of self-stick postage stamps. An optional cutter, preferably in the form of a thin serrated edge, may be adhered to the lid in a spatial relation to the guide bar or the guide bar wedge for providing a convenient cutting location for the excess backing layer which is generated by separating it from self-adhesive stamps. The container may also be weighted and the bottom side thereof may be provided with a non-slip pad or mat so as to resist a tendency to lift or slide when the backing is pulled.

In yet another embodiment, it may be preferred to provide an alternative configuration wherein the bottom side of the lid is releasably attachable to a base such as for example by hook and eye releasable adhesive material, such as, for example, VELCRO ("Velcro" is a registered trademark of Velcro Industries, Inc., of the United States).

Therefore, in accordance with the objects and advantages discussed above, the present invention provides a separating dispenser for self-adhesive stamps, labels, stickers, and the like. The present invention addresses and overcomes these issues, and the invention will now be described in greater detail in conjunction with the appended drawings. The scope of the invention is not be limited to the embodiments given here, but rather shall be limited by the scope of the allowability over the prior art.

BRIEF DESCRIPTION OF THE DRAWINGS

For an understanding of the present invention, reference should be made to the following description taken in conjunction with the below drawings in which like parts are given like reference numerals and, wherein.

DETAILED DESCRIPTION OF THE INVENTION

Figure 1:
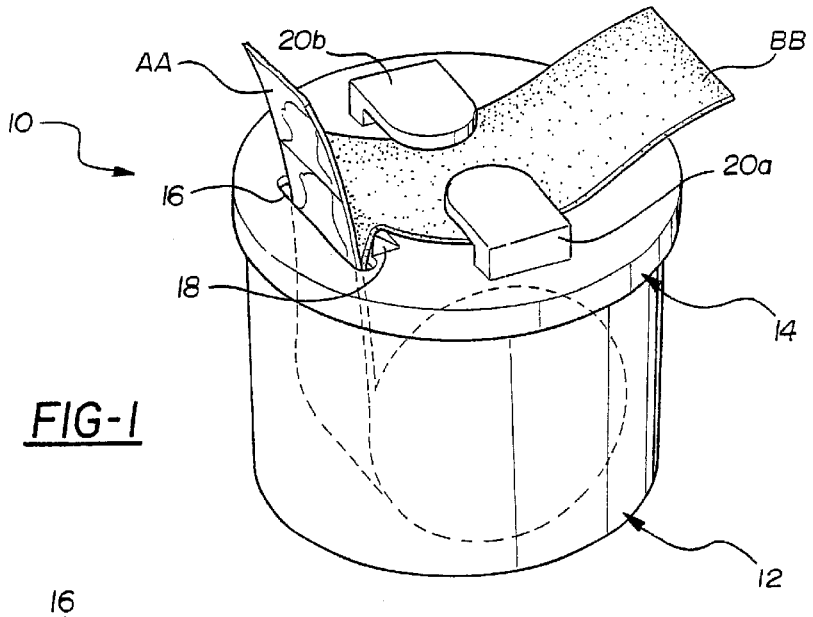
FIG. 1 is a perspective view of the separating dispenser 10.
Figure 2:
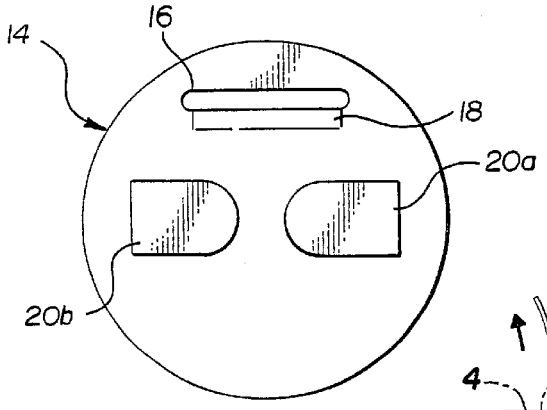
FIG. 2 is a top view of the separating dispenser 10 which shows the upper side of the dispenser cap 14.
Figure 3:
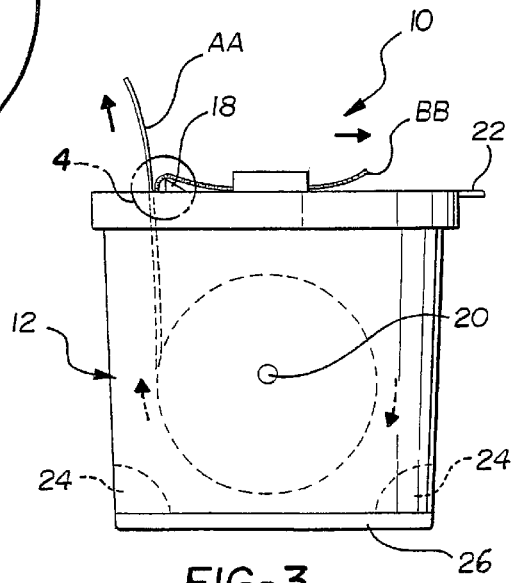
FIG. 3 is a side elevational view of the separating dispenser 10.

As can be seen in FIGS. 1 through 3, there is shown a separating dispenser, generally denoted by the numeral 10, made in accordance with the present invention which may include a substantially cylindrical dispenser container housing 12 having a closed bottom and an open top with a dispenser cap 14 to cover the container housing 12. The container housing may be of any shape, although this embodiment is preferably cylindrical. In the pictured embodiment, housing 12 has a diameter sufficient to permit the placement of a normally sized wound roll of postage stamps readily available from the Post Office or any other self-adhesive strip of a like size. Of course, the dispenser of the present invention may be made of any dimension or shape to accommodate other self-adhesive articles including rolled labels, stickers, and the like. However, for the purposes of this description, we will restrict our comments to a postage stamp dispenser, although realizing that the possible applications in accordance with the present invention go much further than that restricted application.

Returning now to FIG. 1, the dispenser cap 14 is securable to housing 12 and includes a lower surface 14*a* and an upper surface 14*b*, the lower surface 14*a* facing the interior of the housing 12 and the upper surface 14*b* being opposite the lower surface 14*a* and facing upward from the housing 12. Dispenser cap 14 may be secured to the housing by a snap fit, or by a threaded configuration, in addition to any other suitable means for securing the cap to the housing. The dispenser cap 14 includes a slot 16 to allow for the passage therethrough of the stamps, labels, stickers, or the like. The slot 16 has a slot undersurface 16*a* and a slot uppersurface 16*b*, which extend from the lower surface 14*a* to the upper surface 14*b* of the dispenser cap 14 such that postage stamps or any equivalents thereof inserted from the housing 12 interior through the slot under surface 16*a* are dispensed through the slot upper surface 16*b*.

A conventional self-adhesive stamp strip assembly generally has two parts, i.e., the self-adhesive stamp strip and the waxy backing layer for covering and de-tackifying the self-adhesive stamps. Initially, in accordance with the preferred embodiment of the present invention, at the exposed latitudinal edge of the strip assembly, the strip assembly is pulled out of the housing 12 through slot 16, and the waxy backing layer is bent back at least 90° to peel the backing layer from the self-adhesive stamps and over a guide bar wedge means 18, in the direction of a pair of guide pins 20*a* and 20*b*. The guide bar wedge 18 may be rectangular, triangular, circular, or of any suitable shape to accomplish the task of separating the self-adhesive article from its backing.

Guide bar wedge 18 acts to force the latitudinal edge of the self-adhesive article into an upwardly extending position for simple and easy removal by the user, without any extra effort on the part of the user. By using guide bar wedge 18 in conjunction with slot 16, this operation separates the self-adhesive strip from the waxy backing layer, and exposes the respective pre-gummed side of the self-adhesive strip latitudinal edge and waxy backing latitudinal edge. The exposed latitudinal edge of the waxy backing travels from the slot 16, asses over the guide bar wedge 18 and is threaded through the guide pins 20*a* and 20*b*. By forcing the waxy backing layer through this tortuous path, the separation is complete every time.

The preferred guide bar wedge 18 is shaped to change the angle of the path of the backing layer from the slot 16 to the guide pins 18 from about 90° to greater than 90°. Such angle reduction between the slot 16 and the guide pins 20*a*, 20*b*, increases the respective slope, and thereby helps to prevent crimping, jamming and folding back of the self-adhesive strip. Once this arrangement is positioned by threading the waxy backing layer through this path, the stamp dispenser 10 dispenses and separates the waxy backing from the self-adhesive strip by pulling on the latitudinal edge of the carrier backing in a direction away from the slot 16 and through the guide pins 20*a* and 20*b*.

The pair of guide pins 20*a* and 20*b*, when adequately positioned, serve as a simplified yet effective guide that helps to prevent the crimping, jamming and folding back of stamps. Such crimping, jamming and folding back destroys the value of the stamps, labels and other self-adhesive material. The guide pins 20*a* and 20*b* are spaced to permit the longitudinal edges of the carrier backing to be threaded through and restrained by the guide pins 20*a* and 20*b*, and a portion of the waxy backing is unrestrained by the guide pins, thereby reducing the possibility of crimping, jamming and folding back of stamps, particularly when stamps are rapidly dispensed. Such crimping, jamming and folding back can occur between the point of dispension from the housing 12 via the slot 16 to the point of completed passage through the guide pins 20*a* and 20*b*. In addition to the guide pins configuration shown in the Figures, it must be realized that the guide pins could be a single, raised or continuous bar under which the waxy backing would be threaded. Although the guide pins are much easier to thread, it is envisioned by the present inventor that there are many other suitable configurations for holding the waxy backing layer after it is drawn over the guide bar wedge to effect the separation of the backing from the self-adhesive article.

FIG. 3 shows a side view of another embodiment of the present invention which may include optional roll holder means 20 secured within the interior of the container housing 12, such that the roll of the self-adhesive articles is supported in a freely rotatable relation to the lid and the container housing. Further, an optional cutter means 22 may be connected to the lid in a spaced relation to the guide bar wedge means to provide an edge upon which the backing may be cut off when it accumulates after being separated. Optional weight 24 may be included in the base of the separator 10 to provide the user with help for single-handed operation. Furthermore, an optional high friction mat 26 may cover the bottom side to aid the cutting operation by preventing slipping on a desk or other smooth surface. This will help the single-handed user. Other cups, stabilizers and gripping devices may also be utilized without undue experimentation, and they are also contemplated by the present invention and fall within the scope of the invention.

Figure 4:
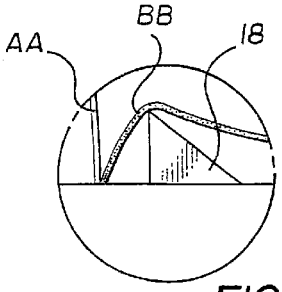
FIG. 4 is a side elevational view of the separator.

FIG. 4 shows a side elevational view of one of the preferred embodiments of the guide bar wedge means of the present invention. Guide bar wedge 18 is located on top of the lid 14, and acts as the separator for the self-adhesive article roll to render the self-adhesive material AA being separated from the waxy backing layer BB. It is also envisioned that the guide bar wedge 18 could be made in other cross-sectional configurations, including rectangular, semicircular, or pyramidal, although the right angle isosceles triangle laying on its back appears to be the best configuration. However, it should be noted that any of these cross-sections may be substituted in without undue experimentation. The present invention also contemplates the use of a dual guide wedge means, and other combinations.

Although all the components may be made of any suitable material, it is envisioned that the present invention be preferably made of a moldable plastic material. The dispenser of the present invention would function equally as well if it was made of wood, and may include clear panels in the sides for viewing the status of the roll, or it may be carved from stone, as many other office supplies are made of these materials to match the desk accessories of workers. The housing is preferably a transparent material as this enables the user to be aware of the stamp supply remaining in the housing, although any suitable material may be used.

What is claimed is:

1. A dispenser for self-adhesive articles having a backing, said dispenser comprising:

a container housing having an interior space;

a lid releasably connectable to said container housing, said lid having an exterior side and an interior side, said lid having a slit formed therein structured for self-adhesive articles to pass therethrough, said slit defining a horizontal slit axis and a vertical slit axis; and guide bar wedge means attached to said external side of said lid adjacent said slit in lateral disposition with respect thereto for the backing of the self-adhesive articles to pass thereover at an angle of at least about 90° in relation to said vertical slit axis; and guide pin means secured to the external side of the lid, adjacent to the guide bar wedge means, for the backing of the self-adhesive articles to pass thereunder, whereby the self-adhesive articles are separated from the backing.

2. The dispenser of claim 1, wherein said guide bar wedge means forms a guide slot with respect to said lid for providing a predetermined path for the backing that is aligned with the horizontal slit axis.

3. The dispenser of claim 1, further comprising snap connection means for snappingly connecting said lid to said container housing.

4. The dispenser of claim 1, further comprising a roll holder means secured in said interior of said container housing for supporting a roll of the self-adhesive articles in freely rotatable relation to said lid and said container housing.

5. The dispenser of claim 1, further comprising a cutter means connected with said lid in spaced relation to said guide bar wedge means for providing an edge upon which the backing is cuttable.

6. The dispenser of claim 1, wherein said container housing has a bottom side, said bottom side being covered by a high friction material.

7. The dispenser of claim 1, wherein said container is weighted substantially adjacent said bottom wall.

8. A method for detaching a backing from a roll of self-adhesive articles having a backing, comprising:

placing a roll of self-adhesive articles within a container having a lid connected thereto;

placing the end of the roll of self-adhesive articles through a slit in the lid, wherein the slit defines a slit axis;

bending the backing of the self-adhesive articles to an angle of at least about 90° to the slit axis adjacent the slit over a guide bar wedge means; and pulling on the backing in a direction substantially parallel to the slit axis, whereby the backing is separated from the self-adhesive articles.

* * * * *